US009700897B2

(12) United States Patent
Viilo et al.

(10) Patent No.: US 9,700,897 B2
(45) Date of Patent: Jul. 11, 2017

(54) ADJUSTING APPARATUS, ADJUSTING SYSTEM, CRUSHER, CRUSHING PLANT AND METHOD FOR ADJUSTING THE CRUSHER

(75) Inventors: Keijo Viilo, Tampere (FI); Kimmo Anttila, Pirkkala (FI); Kari Kuvaja, Tampere (FI); Jouni Mahonen, Tampere (FI); Tero Onnela, Valkkinen (FI); Kari Peltomaki, Tampere (FI); Mika Peltonen, Tampere (FI); Tuomas Takalo, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 735 days.

(21) Appl. No.: 13/978,741

(22) PCT Filed: Jan. 17, 2012

(86) PCT No.: PCT/FI2012/050037
§ 371 (c)(1),
(2), (4) Date: Jul. 9, 2013

(87) PCT Pub. No.: WO2012/098292
PCT Pub. Date: Jul. 26, 2012

(65) Prior Publication Data

US 2013/0277469 A1 Oct. 24, 2013

(30) Foreign Application Priority Data

Jan. 17, 2011 (FI) ..... 20115042

(51) Int. Cl.
*B02C 2/00* (2006.01)
*B02C 25/00* (2006.01)
(Continued)

(52) U.S. Cl.
CPC ..... *B02C 25/00* (2013.01); *B02C 2/007* (2013.01); *B02C 21/02* (2013.01); *B02C 23/02* (2013.01)

(58) Field of Classification Search
CPC ..... B02C 25/00; B02C 23/02; B02C 21/02; B02C 2/007
(Continued)

(56) References Cited

U.S. PATENT DOCUMENTS 233,192 A * 10/1880 Bean ..... B02C 2/007 241/202
369,117 A * 8/1887 Marchant ..... B02C 2/007 222/409
(Continued)

FOREIGN PATENT DOCUMENTS

AU 2685388 A 6/1989
CN 200998672 Y 1/2008
(Continued)

OTHER PUBLICATIONS

Chinese Patent Office Action dated Jul. 23, 2014.
(Continued)

*Primary Examiner* — Faye Francis
(74) *Attorney, Agent, or Firm* — Andrus Intellectual Property Law, LLP

(57) ABSTRACT

An adjusting apparatus of a feed opening of a crushing chamber of a crusher includes one or more adjusting parts arranged in connection with the feed opening, which one or more adjusting parts is/are movable during crushing for adjusting a flow area of material which is to be crushed and is flowing through the feed opening to the crushing chamber. The front edges of the adjusting parts form a unitary flow opening, the flow area of which is adjustable by moving one or more adjusting parts. An adjusting system includes the
(Continued)

adjusting apparatus for a feed opening of a crushing chamber of a crusher. A method for adjusting a pressing crusher or a crushing plant suitable for mineral material crushing. A method for avoiding a start peak of a crusher. A method for limiting power intake and/or crushing pressure of a crusher.

13 Claims, 10 Drawing Sheets

(51) Int. Cl.
*B02C 21/02* (2006.01)
*B02C 23/02* (2006.01)

(58) Field of Classification Search
USPC ..... 241/202, 261.1, 265, 245, 248, 264, 269
See application file for complete search history.

(56) References Cited

U.S. PATENT DOCUMENTS 2,621,860 A 12/1952 Gruender
3,763,772 A * 10/1973 Baker ..... B30B 9/322 100/218
3,813,046 A * 5/1974 Kemnitz ..... B02C 2/007 241/202
3,958,767 A * 5/1976 Stiles ..... B02C 21/02 241/101.76
4,188,876 A * 2/1980 Graves ..... B30B 7/04 100/232
4,899,942 A * 2/1990 Bohringer ..... B02C 1/02 241/200
6,325,313 B1 * 12/2001 Andre ..... B02C 2/007 241/202
8,789,777 B2 * 7/2014 Schenk ..... B02C 1/02 241/264

FOREIGN PATENT DOCUMENTS

CN 101940963 A 1/2011
FR 2 299 088 A1 8/1976
FR 2 927 268 A1 8/2009
GB 2 211 004 A 6/1989
JP 7-171428 A 7/1995
WO 2009/101237 A1 8/2009

OTHER PUBLICATIONS

English translation of Chinese Patent Office Action dated Jul. 23, 2014.
English translation of CN101940963A.
PCT International Search Report dated May 22, 2012.
PCT Written Opinion of the International Searching Authority dated May 22, 2012.
Response to Written Opinion dated Mar. 15, 2013.
Search Report issued in the Finnish priority Application No. 20115042 dated Apr. 24, 2012.
International Preliminary Report on Patentability dated May 2, 2013.

* cited by examiner

| Setting CSS [mm] | Feed Level [cm] | Production CAP [tph] | 6.3/10mm fraction [tph] | 0/2mm fraction [tph] |
|---|---|---|---|---|
| 19 | 50 | 260 | 32.5 | 37.0 |
| 23 | 50 | 323 | 39.4 | 29.4 |
| 19 | 10 | 260 | 30.8 | 25.1 |

ADJUSTING APPARATUS, ADJUSTING SYSTEM, CRUSHER, CRUSHING PLANT AND METHOD FOR ADJUSTING THE CRUSHER

CROSS-REFERENCE TO RELATED APPLICATIONS

This application claims priority to PCT/FI2012/050037, filed Jan. 17, 2012, and published in English on Jul. 26, 2012 as publication number WO 2012/098292, which claims priority to FI Application No. 20115042, filed Jan. 17, 2011, incorporated herein by reference.

FIELD OF THE INVENTION

The invention relates to an adjusting apparatus, an adjusting system, a crusher, a crushing plant and a method for adjusting the crusher. Particularly, though not exclusively, the invention relates to adjusting a crushing chamber of a gyratory or a cone crusher during the crushing event.

BACKGROUND OF THE INVENTION

Rock is gained from the earth for crushing by exploding or excavating. Rock can also be natural and gravel or construction waste. Mobile crushers and stationary crushing applications are used in crushing. An excavator or wheeled loader loads the material to be crushed into the crusher's feed hopper from where the material to be crushed may fall in a jaw of a crusher or a feeder moves the rock material towards the crusher.

Intermediate and fine crushing is continued generally with gyratory and cone crushers after a jaw crusher. Then it is an object to produce for example gravel or fine sand. Gyratory and cone crushers break all rock materials but not always recycled materials. Big primary cone crushers are used in mines in the primary crushing phase and other mining and quarrying applications which are requiring large capacity. Small rock crushing plants can yield 100 to 300 tons of crushed rock per hour, middle sized 300 to 600 and large plants 600 to 1 000 tons per hour. The largest rock crushing plants may produce even more than 2 000 tons crushed rock per hour. For instance 25 000 to 50 000 tons of crushed rock are required for making an asphalt road which is one kilometer long and ten meter wide.

Gyratory and cone crushers are adjusted for different production requirements by changing the profile of the crushing chamber, the amount of the eccentric movement, i.e. the stroke, the rotation speed of the crushing cone and the setting of the crusher.

Surface height of the material to be crushed is influencing product distribution and power intake of the crusher. When the surface height in the feed hopper is high, pressure of the material downwards in direction of the crushing chamber is increasing. The high pressure is changing function of the crushing chamber and causes increasing wear of wear parts of the crusher. Additionally the crusher is consuming more energy and the end product distribution is changing. The power increase is also increasing the finer end product 0-4 mm which is giving a lesser sales price than the objected coarser end product.

The crushing chamber of current crushers cannot be adjusted during crushing. The adjusting takes place by changing the wear parts or part of the wear parts of the crusher. The gyratory/cone crusher has to be stopped and partly disassembled for this purpose.

A relieving stationary shelf has been used in some crushers in the upper portion of the crushing chamber, the purpose of this has been to prevent crushing of stones in the upper portion of the jaw.

The fine material produced by the crusher and the power required by the crusher cannot be adjusted satisfactorily by the prior art technology.

JP 2002018297 A describes a cone crusher by which mineral material is crushed by moving the moving cone in relation to a stationary crushing chamber. The crusher is equipped with a feed hopper by which the material to be crushed is directed through a feed opening to the crushing chamber.

EP 0628348 B1 describes an impact based crusher in which the material to be crushed is shot by a rotor which is rotating around a vertical axis in side direction against a crush wall. A storage silo is connected in front of the crusher wherefrom the material flows through a feed opening to the crushing chamber. It is tried to avoid proceeding of superfluous air in the crusher and to decrease generation of dust.

An object of the invention is to adjust a crusher during crushing. A second object of the invention is to control the power intake of a crusher. A further object of the invention is to adjust the product distribution and particularly the amount of the fine material produced by a crusher.

SUMMARY

According to a first example aspect of the invention there is provided an adjusting apparatus of a feed opening of a crushing chamber of a crusher, the adjusting apparatus comprising one or more adjusting parts to be arranged in connection with the feed opening, the one or more adjusting parts is/are movable during crushing for adjusting a flow area of material which is to be crushed and is flowing through the feed opening to the crushing chamber.

According to a second example aspect of the invention there is provided an adjusting apparatus of a feed opening of a crushing chamber of a crusher, the adjusting apparatus comprising one or more adjusting parts to be arranged in connection with the feed opening, the one or more adjusting parts is/are movable during crushing for adjusting a flow area of material which is to be crushed and is flowing through the feed opening to the crushing chamber, and front edges of the adjusting parts are forming a unitary flow opening, the flow area of which flow opening is adjustable by moving the one or more adjusting parts.

Preferably the adjusting part is configured to be moved such that the flow area of the material to be crushed is decreased by the adjusting part for reducing material in the crushing chamber and the flow area of the material to be crushed is increased by the adjusting part for adding material in the crushing chamber.

Preferably the adjusting apparatus comprises a flow opening having a flow area which is adjustable by moving one or more adjusting parts.

Preferably the adjusting part is configured to be moved such that the adjusting part is moved towards the flow opening for decreasing the flow area of the flow opening and reducing the material to be crushed flowing to the crushing chamber, and the adjusting part is moved away from the flow opening for increasing the flow area of the flow opening and adding the material to be crushed flowing to the crushing chamber.

Preferably a front edge of the adjusting part is defining at least part of the flow area of the material to be crushed or of the flow area of the flow opening.

Preferably the adjusting part is locatable before the feed opening in flow direction of the material to be crushed.

Preferably the adjusting apparatus comprises a body and one or more adjusting parts attached to the body, and the front edges of the adjusting parts are forming a flow opening having a flow area which is adjustable by moving the adjusting parts.

Preferably the adjusting parts are bearing-mounted at their first ends to the body by rotating axes and second ends of the adjusting parts are rotatable around the rotating axes. Preferably the rotating axes are vertical.

Preferably the body comprises a bottom part and an upper part fixed together and the adjusting parts are supported between the bottom part and the upper part in vertical direction. The adjusting parts are preferably arranged in a ring around the flow area and the front edges of the adjusting parts are curved. At least part of the adjusting parts may be arranged partly on top of each other in two layers. The body and/or the adjusting parts comprised by the adjusting apparatus may be plate structures.

According to a third example aspect of the invention there is provided an adjusting system comprising an adjusting apparatus for a feed opening of a crushing chamber of a crusher, and the adjusting apparatus comprises one or more adjusting parts to be arranged in connection with the feed opening, which one or more adjusting parts are movable during crushing for adjusting a flow area of material which is to be crushed and is flowing through the feed opening to the crushing chamber, and the adjusting system comprises a measuring means for measuring crushing power used and/or crushing pressure present in a crushing event which is taking place in the crushing chamber, and the adjusting system is arranged to adjust the adjusting apparatus such that the flow area is decreasing when the crushing power and/or the crushing pressure measured by the measuring means is increasing and the flow area is increasing when the crushing power and/or the crushing pressure measured by the measuring means is decreasing. Preferably the adjusting system comprises an adjusting apparatus according to an embodiment of the invention.

According to a fourth example aspect of the invention there is provided an adjusting system comprising an adjusting apparatus for a feed opening of a crushing chamber of a crusher, and the adjusting apparatus comprises one or more adjusting parts to be arranged in connection with the feed opening, which one or more adjusting parts are movable during crushing for adjusting a flow area of material which is to be crushed and is flowing through the feed opening to the crushing chamber, and front edges of the adjusting parts are forming a unitary flow opening, the flow area of which flow opening is adjustable by moving the one or more adjusting parts, and the adjusting system comprises a measuring means for measuring crushing power used and/or crushing pressure present and/or surface height in a crushing event which is taking place in the crushing chamber, and the adjusting system is arranged to adjust the adjusting apparatus such that the flow area is decreasing when the crushing power and/or the crushing pressure and/or the surface height measured by the measuring means is increasing and the flow area is increasing when the crushing power and/or the crushing pressure and/or the surface height measured by the measuring means is decreasing. Preferably the adjusting system comprises an adjusting apparatus according to an embodiment of the invention.

According to a fifth example aspect of the invention there is provided a pressing crusher suitable for mineral material crushing comprising a crushing chamber and a feed opening of the crushing chamber, and the crusher comprises a measuring means for measuring a crushing power used and/or a crushing pressure present in a crushing event which is taking place in the crushing chamber, an adjusting apparatus comprising one or more adjusting parts to be arranged in connection with the feed opening, which one or more adjusting parts is/are movable during crushing for adjusting a flow area of material which is to be crushed and is flowing through the feed opening to the crushing chamber, and the one or more adjusting parts is/are configured to move such that the flow area is decreasing when a crushing power and/or a crushing pressure measured by a measuring means is increasing and the flow area is increasing when the crushing power and/or the crushing pressure measured by the measuring means is decreasing.

According to a sixth example aspect of the invention there is provided a pressing crusher suitable for mineral material crushing comprising a crushing chamber and a feed opening of the crushing chamber, and the crusher comprises a measuring means for measuring a crushing power used and/or a crushing pressure present and/or surface height in a crushing event which is taking place in the crushing chamber, an adjusting apparatus comprising one or more adjusting parts to be arranged in connection with the feed opening, which one or more adjusting parts is/are movable during crushing for adjusting a flow area of material which is to be crushed and is flowing through the feed opening to the crushing chamber, and front edges of the adjusting parts are forming a unitary flow opening, the flow area of which flow opening is adjustable by moving the one or more adjusting parts, and the one or more adjusting parts is/are configured to move such that the flow area is decreasing when the crushing power and/or the crushing pressure and/or the surface height measured by the measuring means is increasing and the flow area is increasing when the crushing power and/or the crushing pressure and/or the surface height measured by the measuring means is decreasing.

Preferably the crusher comprises a crusher drive and an adjusting system with feedback, which adjusting system comprises a power measuring means of the crusher drive and/or a pressure measuring means of the crushing event and moving means of the adjusting parts for adjusting the adjusting parts based on the power measuring and/or the pressure measuring.

Preferably the crusher is a gyratory or a cone crusher.

The crusher may comprise a stationary wear part and a movable wear part, the distance between the stationary wear part and the movable wear part being changing during crushing.

The crusher may comprise an adjusting apparatus according to an embodiment of the invention or an adjusting system according to an embodiment of the invention.

According to a fourth aspect of the invention there is provided a crushing plant comprising a crusher according to an embodiment of the invention.

According to a seventh example aspect of the invention there is provided a method for adjusting a pressing crusher or a crushing plant suitable for mineral material crushing, which crusher or crushing plant comprises a crushing chamber and a feed opening of the crushing chamber, and the crusher or the crushing plant comprises a measuring means by which is measured a crushing power used and/or a crushing pressure present in a crushing event, an adjusting apparatus which is comprising one or more movable adjusting parts which one or more movable adjusting parts is/are arranged in connection with the feed opening and a flow area of material which is to be crushed and is flowing through the feed opening to the crushing chamber is adjusted during crushing by moving the adjusting parts such that the flow area is decreased when the crushing power and/or the crushing pressure measured by the measuring means is increasing and the flow area is increased when the crushing power and/or the crushing pressure measured by the measuring means is decreasing.

According to a eight example aspect of the invention there is provided a method for adjusting a pressing crusher or a crushing plant suitable for mineral material crushing, which crusher or crushing plant comprises a crushing chamber and a feed opening of the crushing chamber, and the crusher or the crushing plant comprises a measuring means and an adjusting apparatus, the method comprising: measuring by the measuring means a crushing power used and/or a crushing pressure present and/or a surface height in a crushing event; arranging one or more movable adjusting parts comprised by the adjusting apparatus in connection with the feed opening; forming by front edges of the adjusting parts a unitary flow opening; adjusting the flow area of the unitary flow opening by moving the one or more adjusting parts; and adjusting during crushing a flow area of material which is to be crushed and is flowing through the feed opening to the crushing chamber by moving the adjusting parts such that the flow area is decreased when the crushing power and/or the crushing pressure and/or the surface height measured by the measuring means is increasing and the flow area is increased when the crushing power and/or the crushing pressure and/or the surface height measured by the measuring means is decreasing.

In the method the crusher may comprise a crusher drive and an adjusting system with a feedback, which adjusting system comprises a power measuring means of the crusher drive and/or a pressure measuring means of the crushing event and moving means of the adjusting parts, and the method comprising measuring by the power measuring means the power of the crusher drive and/or by the pressure measuring means the pressure of the crushing event, and moving the adjusting parts based on the power measuring and/or the pressure measuring.

In the method the adjusting apparatus may comprise an adjusting apparatus according to an embodiment of the invention or the crusher may comprise a crusher according to an embodiment of the invention or the crushing plant may comprise a crushing plant comprising a crusher according to an embodiment of the invention.

According to a ninth example aspect of the invention there is provided a method for adjusting a pressing crusher or a crushing plant suitable for mineral material crushing, which crusher or crushing plant comprises a crushing chamber and a feed opening of the crushing chamber and measuring means for measuring production amounts of at least two different fractions from the crushed material, and an adjusting apparatus, one or more adjusting parts comprised by which adjusting apparatus are arranged in connection with the feed opening, the method comprising adjusting during crushing a location of a flow opening formed by the movable adjusting parts of the adjusting apparatus and/or the size of the flow opening in relation to the feed opening as a response to a change of the production amount of the fraction. Preferably the location of the flow opening of the adjusting apparatus is adjusted in vertical and/or horizontal direction. Preferably a flow area of material which is to be crushed and is flowing through the feed opening to the crushing chamber is further adjusted during crushing by moving the adjusting parts such that the flow area is decreased when the crushing power and/or the crushing pressure and/or the surface height measured by the measuring means is increasing and the flow area is increased when the crushing power and/or the crushing pressure and/or the surface height measured by the measuring means is decreasing.

According to a tenth example aspect of the invention there is provided a method for avoiding a start peak of a crusher, in connection of which crusher there is arranged an adjusting apparatus which comprises one or more movable adjusting parts in connection with the feed opening of the crushing chamber of the crusher, the method comprising measuring a change of surface height of the material to be crushed and setting a flow opening comprised by the movable adjusting parts of the adjusting apparatus in a minimum size if the power of the crusher, the pressure in the crushing chamber or the surface height of the material to be crushed reaches a predetermined limit such as the power, the pressure or the surface height in an idle situation of the crusher. Preferably the setting of the crusher is further decreased towards the minimum value. Preferably the setting and the size of the flow opening are increased as a response to the change of the surface height.

According to an eleventh example aspect of the invention there is provided a method for limiting power intake and/or crushing pressure of a crusher in connection with crushing, which crusher comprises a feed hopper above the crushing chamber, and the method comprising forming by one or more movable adjusting parts comprised by an adjusting apparatus a flow opening in connection with a feed opening of the crushing chamber and adjusting the size of the flow opening such that a surface height of the material to be crushed in the feed hopper does not cause overriding of a predetermined power or pressure limit during crushing.

The power intake of the crusher can be controlled by the adjusting solution. The adjustment can be connected to an automation system of the crusher. A connecting and adjusting arrangement with feedback can be formed in the crusher, particularly in the automation system of the crusher, between measured crusher power and the adjustable flow opening.

The product distribution can be adjusted by the adjusting solution, particularly a lower portion of the product distribution can be adjusted by the flow opening of the material to be crushed, the flow area of which flow opening is adjustable. The amount of fine material produced by the crusher can be reduced by the adjusting solution. Generally the fraction 0-4 mm is being formed in excess in the crushing process and for adjusting that fraction a chance as good as here is not known in the traditional technology.

The adjustable flow opening may be a separate adjusting apparatus relative the feed opening of the crusher or a detachable adjusting apparatus or the movable adjusting parts for adjusting the area the flow opening may be integrated to the feed opening of the crusher. The separate adjusting apparatus relative the feed opening of the crusher may be, without a separate fixing, liftable in place in connection with the feed opening and liftable away. The adjusting apparatus may be mounted between the feed opening of the crusher and the feed hopper. In some cases the feed hopper and the material in the feed hopper may hold in place the adjusting apparatus also during the crushing event.

By the adjusting solution also the amount of crushing chambers can in some cases be reduced, i.e. the crushing process may perform with a smaller amount of successive and/or parallel crushing chambers. The reducing of the crushing chambers creates substantial economic and space savings, also in form of auxiliary apparatuses such as conveyors which can be left away.

By the adjusting solution the material distribution in different parts of the crushing chamber can be adjusted in some cases so that by the adjusting parts more material is directed to a desired point of the crushing chamber where there is less material. By moving the adjusting parts the material flow can be directed from a more material containing part of the crushing chamber to a less material containing part of the crushing chamber and so even out the power intake and the crushing pressure of the crusher.

Different embodiments of the present invention will be illustrated or have been illustrated only in combination with one or some aspects of the invention. A person skilled in the art understands, that any embodiment of one aspect of the invention may be applied in the same aspect of the invention and in other aspects alone or as a combination with other embodiments.

BRIEF DESCRIPTION OF THE DRAWINGS

The invention will be described, by way of example, with reference to the accompanying drawings, in which.

DETAILED DESCRIPTION

In the following description, like numbers denote like elements. It should be appreciated that the illustrated drawings are not entirely in scale, and that the drawings mainly serve the purpose of illustrating embodiments of the invention.

Figure 1:
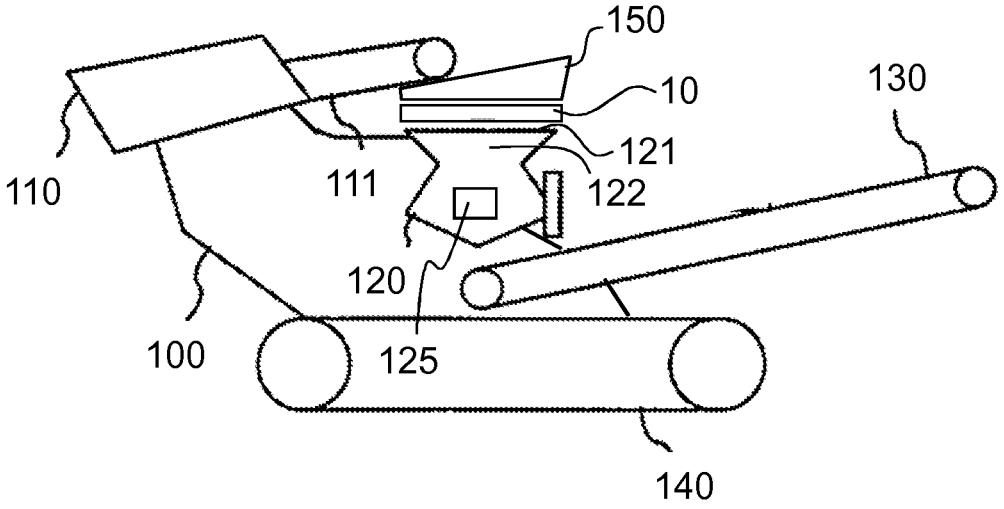
FIG. 1 shows a crushing plant comprising a crusher and the crushing chamber of the crusher is adjustable during crushing.

A movable track based crushing plant 100 which comprises a feeder 110 is shown in FIG. 1. Preferably the feeder also comprises a conveyor 111. The crushing plant comprises a crusher 120 such as a cone or gyratory crusher. The crusher can be used for example as an intermediate or secondary crusher. Particularly the crusher can be used in fine crushing. The crushing plant comprises a conveyor 130 and a track base 140. The mobile crushing plant may be movable also by other means such as wheels, runners or legs. The crushing plant may also be stationary.

The crushing plant comprises a feed hopper 150 above a feed opening 121 of a crushing chamber 122 of the crusher 120. When the crushing process is in progress the material to be crushed is fed to the feeder 110 where from it is fed further by the conveyor 111 to the crusher 120. The feeder 110 may also be a so called scalper feeder. The material to be crushed coming from the conveyor is directed by the feed hopper 150 to the feed opening 121. The material to be crushed can be fed to the fed hopper 150 also directly, for example, by a loader.

The crushing plant comprises an adjusting apparatus 10 for adjusting the crushing chamber 122. The adjusting apparatus 10 is described in more detail in connection with FIGS. 2 to 6.

The material to be crushed is left via the feed opening 121 which is controlled by the adjusting apparatus 10 to the crushing chamber 122. The adjusting apparatus 10 is located above the feed opening 121 so that the flow of the material to be crushed to the crushing chamber 122 can be adjusted. Preferably the adjusting apparatus 10 comprises an adjustable flow opening 11 for the material to be crushed. The flow opening can be enlarged or reduced, if desired. The feed hopper 150 is located above the adjusting apparatus 10. The material to be crushed is directed to proceed from the feed hopper 150 to the crushing chamber 122 through (the adjustable flow opening 11 of) the adjusting apparatus 10. In some cases the feed hopper 150 can be used as an intermediate storage of the material to be crushed before the crushing chamber. Troubles in the crushing process caused by the input such as for instance variations of the surface height in the feed hopper can be avoided, for example rising of pressure in the bottom portion of the crushing chamber can be corrected quickly, preferably even during one revolution of the crusher. Preferably problems caused by the rising of the pressure such as increased power demand and overproduction of fine material can quickly be passed by adjusting the flow area A of the material to be crushed in connection with the feed opening 121. In this solution, surface height of the material in the feed hopper has no major impact on the end result and therefore the solution is well suitable for mobile apparatuses.

If desired, the flow opening can enlarged or reduced based on power measurement of the crusher. For example when the material is beginning to pack in the bottom portion of the crushing chamber and the power demand of the crusher is increasing, a control with feedback can be formed from the measured power according to which the adjusting parts are moved in order to reduce the flow area A of the material to be crushed. When the power demand of a crusher drive is decreasing a control can be formed according to which the adjusting parts are moved in order to enlarge the flow area of the material to be crushed.

Figure 2:
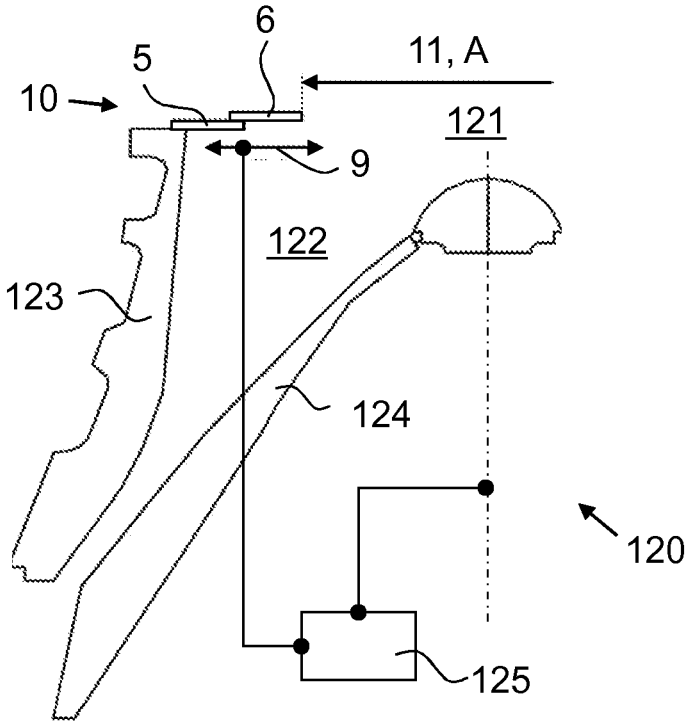
FIG. 2 shows a gyratory or cone crusher where the flow in the crushing chamber of the flowing material to be crushed can be adjusted according to preferable embodiments of the invention.

In FIGS. 1 and 2 the crusher or the crushing plant comprises a measuring means 125 by which is measured the used crushing power and/or the crushing pressure present in a crushing event which is taking place in the crushing chamber 122.

FIG. 2 shows a side view of a partial section the crusher 120. The flow area A of the feed opening 121 of the crusher can be adjusted by moving the adjusting parts 5, 6 of the adjusting apparatus 10 in connection with the feed opening (arrow 9). Preferably the adjusting parts are moved based on crushing power and 7 or crushing pressure measured by the measuring means 125. The crushing chamber 122 is located between a stationary outer wear part 123 and a rotating inner wear part 124. Flowing of the material to be crushed which is led from the feed hopper 150 to the crushing chamber can be decreased and increased for adjusting the power, adjusting pressure and product distribution of the cone or gyratory crusher. The adjusting method can be implemented in some cases also for other types of crushers such as jaw crushers. Impact of pressure caused by the surface height of the material in the feed hopper can now be controlled better than in the past. It has been found that the power demand of the crusher can be reduced more by the change of the upper portion of the crushing chamber produced by use of the adjusting parts than by a geometry change directed to the bottom portion of the chamber. The pressure directed towards the material in the bottom portion of the chamber can be limited by the adjusting parts wherein the material does not pack dense in the bottom portion of the crushing chamber. The power taken by the crusher is decreasing and a coarser end product can be produced without too much fine material and dust when the vertical pressure is limited by the adjusting parts.

FIGS. 3 to 6 show an adjusting apparatus 10 with a flow opening 11 which is depicted in different adjusting states. The largest adjusting state of the flow opening is shown exemplary with a circle 11' and the smallest adjusting state with a circle 11".

The adjusting apparatus 10 comprises a body 1 and adjusting parts 5, 6, 7, 8 attached to the body. The front edges 5.1, 6.1, 7.1, 8.1 of the adjusting parts are forming the flow opening 11 having a flow area A which is adjustable by moving the adjusting parts. The body comprises a bottom part 2 and an upper part 2 which are attached together. The adjusting parts are supported between the bottom part and the upper part in vertical direction. The adjusting parts are fixed together by intermediate parts 4. The intermediate parts preferably are limiting a movement of the adjusting parts backwards such that the curved front edges of the adjusting parts are forming a circular flow opening 11 in the rear position of the adjusting parts. The body and the adjusting parts are preferably plate structures. Preferably the body 1 is formed of two fixed plate rings 2, 3. The opening in the middle of the plate rings has preferably the size of the feed opening 121.

The adjusting parts such as the adjusting plates can be moved by movement actuators known per se for example mechanically, electrically, hydraulically, electromechanically, electrohydraulically, hydraulic-mechanically or by a combination of the aforementioned actuating methods. The adjusting movement of the adjusting part may be implemented directly or indirectly for example via a transmission device comprising a transmission or a lever.

The movement actuator is acting at least to one adjusting part. The adjusting movement can be communicated by the actuator from the moved adjusting part to another or several adjusting parts for example mechanically so that all adjusting parts need not necessarily be equipped with an individual actuator.

The adjusting parts are bearing-mounted at their first ends to the body 1 by rotating axes 5', 6', 7', 8' and the second ends of the adjusting parts are rotatable around the rotating axes in FIGS. 3 to 6. Preferably at least part of the adjusting parts are arranged partly on top of each other in two layers. In the embodiments of FIGS. 3 to 6 the adjusting parts are formed of four movable plates which are arranged in different layers so that every second plate is up and every second plate is down. The plates 5 and 7 below are bearing-mounted to the bottom part 2 of the body and the plates 6 and 8 above are bearing-mounted to the upper part 3 of the body.

At least part of the adjusting parts are preferably arranged so that under vertical load of the material to be crushed a first end of the below adjusting part 5, 7 is supporting a second end of the neighboring adjusting part 6, 8. The bottom part 2 of the body 1 is supporting second ends of the below adjusting parts 5, 7.

Preferably the adjusting parts are arranged in a ring around the flow area A and the front edges of the adjusting parts are preferably curved. Preferably the curvature of the front edge is of same size than the curvature of the edge of the feed opening 121. So the flow opening 11 of the adjusting part is formed equal with the feed opening 121 when the adjusting parts are in the rear position. It is also possible that the flow opening of the adjusting apparatus in the largest position is formed of the edge of the upper and/or bottom part of the body wherein the adjusting parts can be in the rear position totally wear protected by the body.

Figure 3:
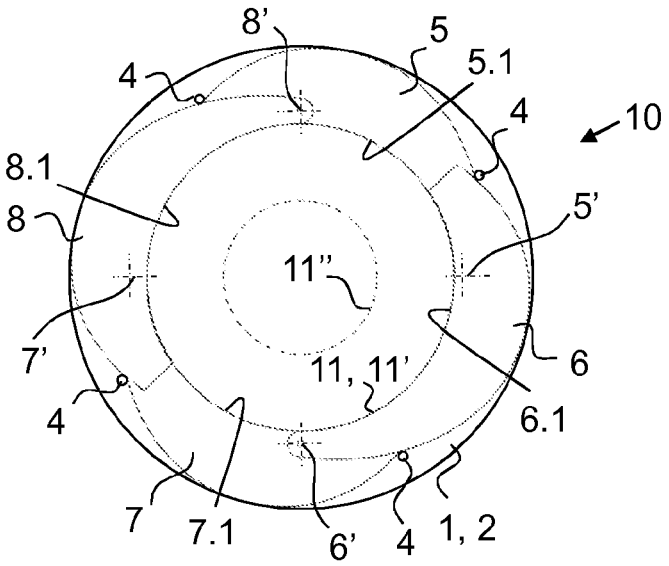
FIG. 3 shows a top view of an adjusting apparatus according to a preferable embodiment of the invention, and the flow opening of the adjusting apparatus is fully open.
Figure 4:
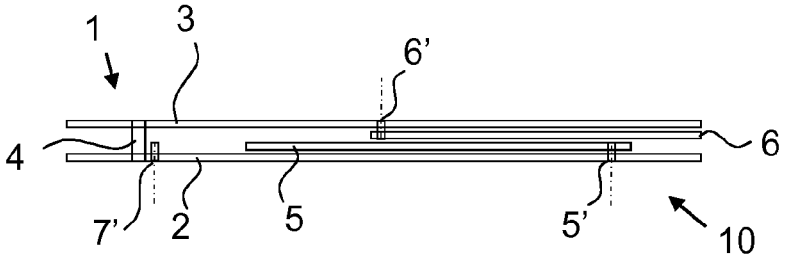
FIG. 4 shows a side view of the adjusting apparatus of FIG. 3 equipped with adjusting parts, part of which is shown.

FIG. 4 shows a side view of the adjusting apparatus of FIG. 3 equipped with adjusting parts of which only two are shown.

Figure 5:
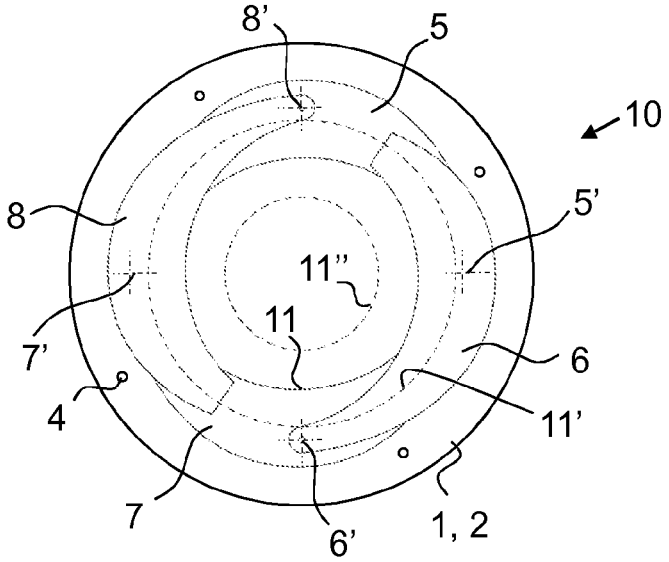
FIGS. 5 and 6 show the adjusting apparatus of FIG. 3 in positions in which the adjusting parts are limiting the flow area of the flow opening.
Figure 6:
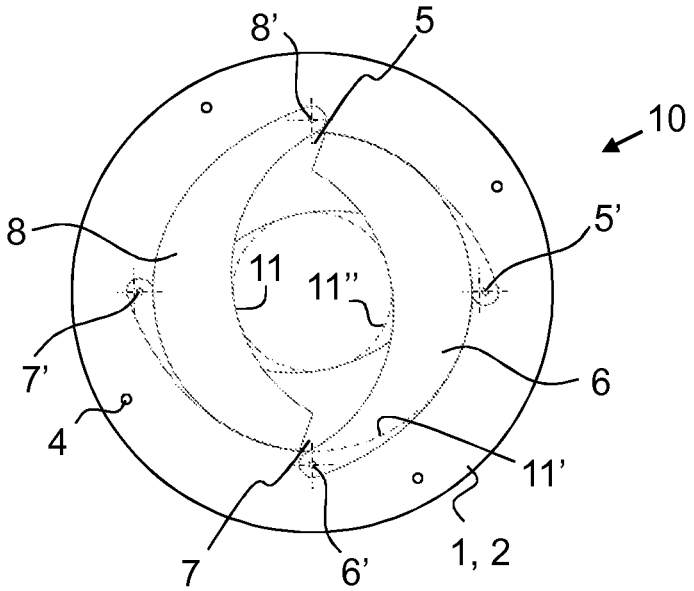

The flow opening 11 is wholly open in FIG. 3 wherein the rotation angle of the adjusting parts 5, 6, 7, 8 is 0 degrees. FIGS. 5 and 6 show the adjusting apparatus of FIG. 3 in positions in which the adjusting parts are limiting the flow area of the flow opening. The rotation angle of the adjusting parts is about 13 degrees in FIG. 5 wherein a radius of a circle to be arranged in the flow opening is about 75% of the radius of a circle describing the largest adjustment state 11' of the flow opening. The rotation angle of the adjusting parts is about 27 degrees in FIG. 6 wherein a radius of a circle to be arranged in the flow opening is about 50% of the radius of a circle describing the largest adjustment state 11' of the flow opening.

The adjusting apparatus can in some cases be formed as a horizontal shelf to be mounted in the upper portion of the jaw or chamber of the crusher which shelf is circular when viewed in a top view. The shelf can be adjusted is direction of the radius of a circle so that the diameter of the feed opening is changing. The adjustment can be done during the crushing. One solution for changing the feed opening is a technique like the aperture adjustment of a camera, the adjusting apparatus 10 shown above being one example of such.

Figure 7:
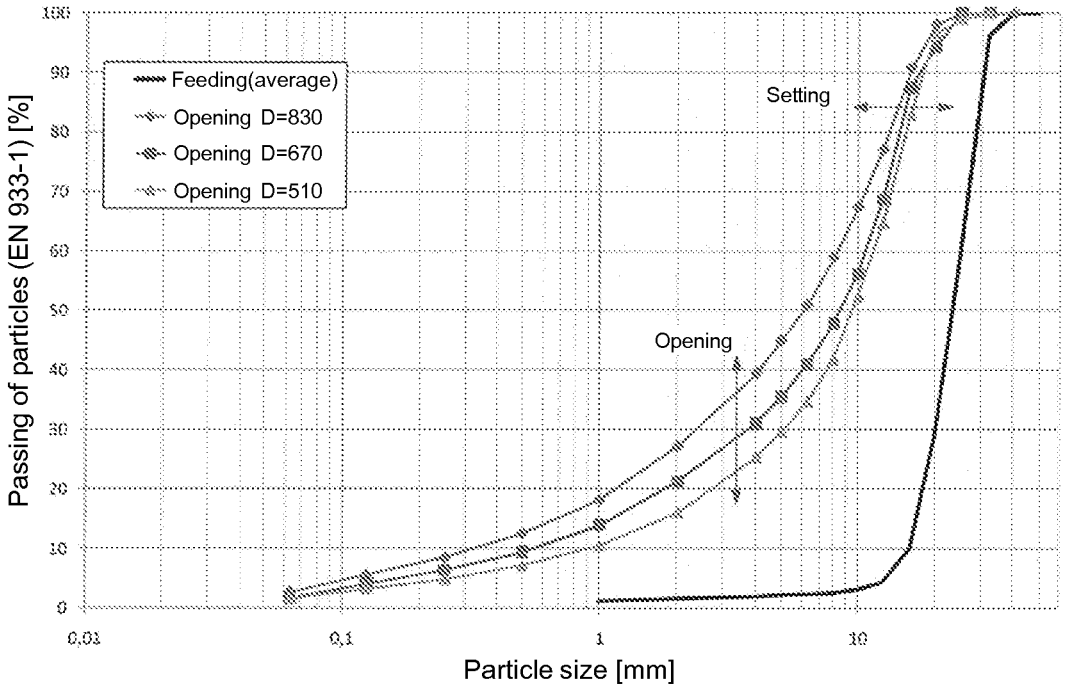
FIG. 7 shows schematically the impact of the change of the flow opening on the product distribution of the crusher.

FIG. 7 shows schematically the impact of the change of the flow opening (change of the flow area of the material to be crushed) on the product distribution of the crusher. The material of the crushing process was Granodiorite and the setting (CSS) of the test crusher was 16 mm. In the process there was crushed with circular flow openings having diameters 830, 670 and 510 mm.

Particle size is shown on the horizontal axis and particle passing on the vertical axis of the diagram. A unitary thick line is showing the input with a grain size 12 to 32 mm.

It can be found from product distributions made in different crushing events that the upper portion of the product distribution can be adjusted by the setting of the crushing chamber and the bottom portion of the product distribution can be adjusted by the feed adjustment opening. In FIG. 7, 830 mm responds to the wholly open portion of the chamber of the test crusher and the two others respond to adjustment openings reduced with steps of 160 mm. As adjusting values the numbers can respond to a percentage of the diameter of the maximum or a percentage of the area of the feed opening of the maximum according to next table.

| Diameter of feed opening | Diameter of maximum | Area A of maximum |
|---|---|---|
| 830 mm | 100% | 100% |
| 670 mm | 81% | 65% |
| 510 mm | 61% | 38% |

When the product distributions of FIG. 7 are viewed at particle size 4 mm it can be found that the product after the crushing contains 40% fractions 0-4 mm when the feed opening has the maximum area. The product after the crushing contains 30% fractions 0-4 mm when the area of the feed opening is 65% of the maximum area. The product after the crushing contains 25% fractions 0-4 mm when the area of the feed opening is 38% of the maximum area.

The curves of the product distributions in FIG. 7 show as an advantage of the adjustable crushing chamber that a producer of crushed rock material can offer to the client a certain quality with a variation range which can be adjusted smaller. The producer can produce a certain rock material quality with a good margin, for example 32-60 mm railway ballast, with smaller loss percentage of the rock material and smaller energy consumption. Significant benefits can be achieved even with a small reduction of the percentage of the unnecessary fine rock material. Wearing of the wear parts of the crusher is decreasing and change intervals of the wear parts increase when more coarse rock material can be produced relatively, if desired. As an advantage can still be mentioned that the wear the wear parts can be compensated to some degree by adjusting the flow opening and so the operating costs of the crusher can be reduced. This is further improving the margin from the crushing.

Figure 8:
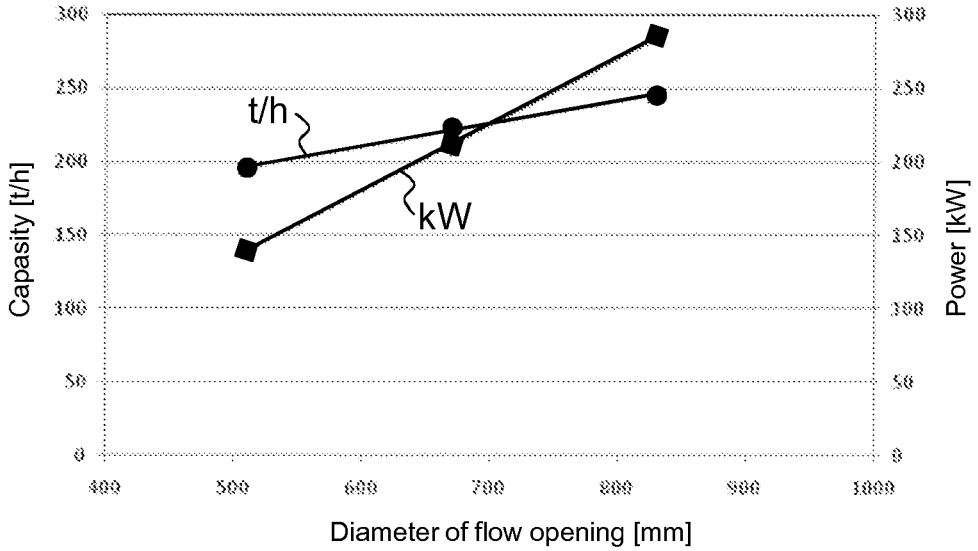
FIG. 8 shows relation of the size of the flow opening to the power and capacity of the crusher.

FIG. 8 shows relation of the size of the flow opening to the power and capacity of the crusher found in the crushing test described above. When the diameter of the flow opening of the test crusher was reduced from 830 mm to 510 mm, the power of the crusher dropped from 280 kW to 130 kW. At the same time the capacity of the crusher dropped from 240 t/h to 190 t/h. When the flow area A or the flow opening 11 of the adjusting apparatus 10 is reduced, the power required by the crusher 120 drops quickly. This can be utilized such that the power is not adjusted by changing the setting but by changing the area of the flow opening 11. Then the maximum size of the product will remain almost constant. A suitable minimum setting can also be sought by the flow opening. The flow opening is adjusted small without losing however much of the capacity, if a very small setting is required.

FIGS. 9*a* to 9*f*, 10*a* to 10*b* and 11*a* to 11*b* show some preferable embodiments of the adjusting apparatus.

Figure 9A:
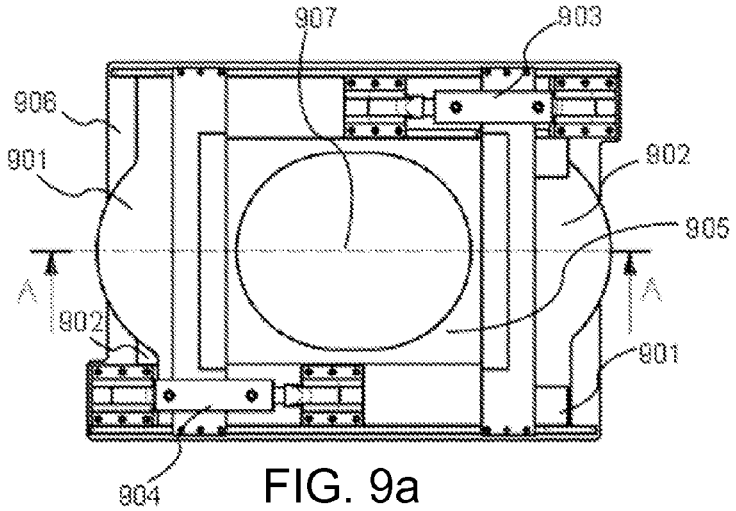
FIGS. 9*a*, 9*b* and 9*c* show a top view of two adjusting parts of an adjusting apparatus according to a preferable embodiment of the invention in different positions.
Figure 9B:
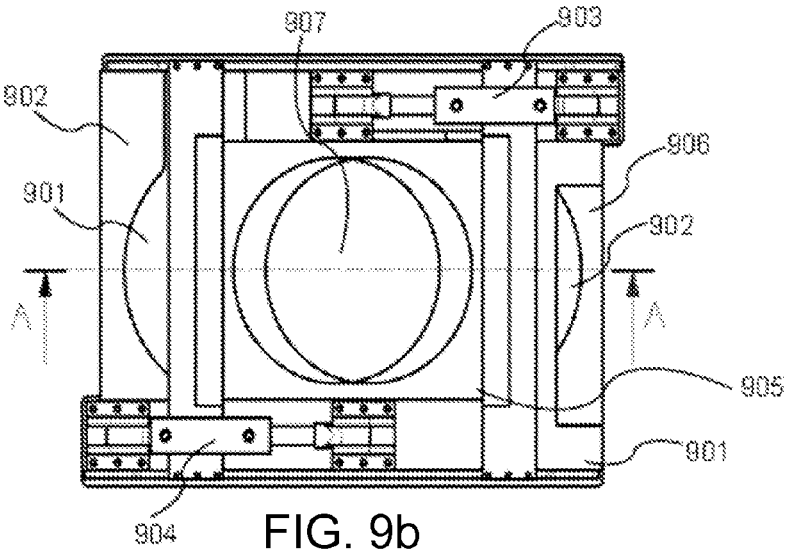
Figure 9C:
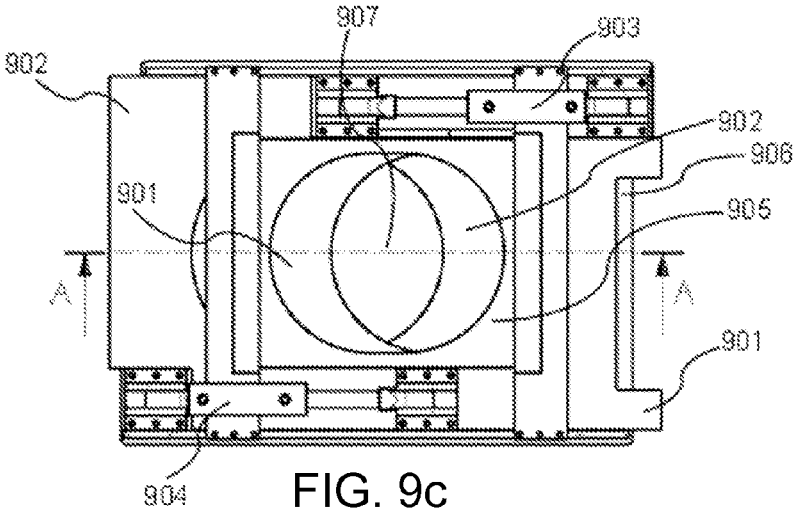
Figure 9D:
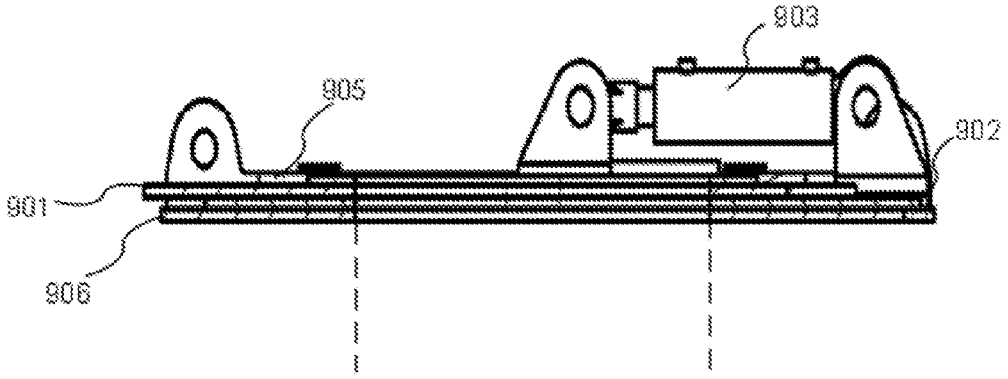
FIGS. 9*d*, 9*e* and 9*f* show a side view of sections of the adjusting apparatus shown in FIGS. 9*a* to 9*c* along the line A-A.
Figure 9E:
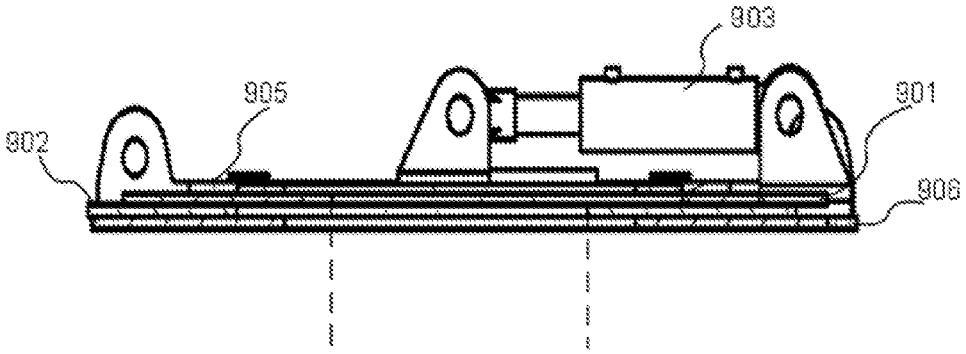
Figure 9F:
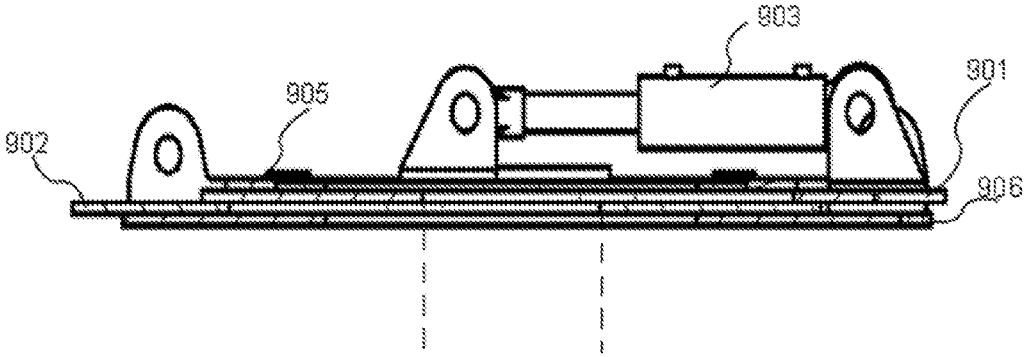

FIGS. 9*a* to 9*c* show a top view of two adjusting parts of an adjusting apparatus according to a preferable embodiment of the invention in different positions and FIGS. 9*d* to 9*f* show a side view of sections of the adjusting apparatus shown in FIGS. 9*a* to 9*c* along the line A-A.

In FIGS. 9*a* to 9*f*, an upper adjusting plate 901 is moving from left to right when a flow opening 907 of the adjusting apparatus is decreasing. The lower adjusting plate 902 is moving from right to left when the flow opening 907 is decreasing. The lower adjusting plate 902 is moved by a first adjusting cylinder 903. The upper adjusting plate 901 is moved by a second adjusting cylinder 904. An uppermost plate 905 is in contact with the material to be crushed. Preferably the uppermost plate 905 is defining the largest size of the flow opening 907. The adjusting plates are mounted movable between the uppermost plate 905 and a lowermost plate 906. The upper adjusting plate and the lower adjusting plate are acting as adjusting parts which are movable during crushing for adjusting the flow area A of the material which is to be crushed and is flowing through the feed opening 121 to the crushing chamber 122.

The actuators (adjusting cylinders) controlling the size of the flow opening 907 are arranged between the body (for example, the uppermost plate 905 and/or the lowermost plate 906) and the adjusting part (adjusting plate) of the adjusting apparatus in FIGS. 9*a* to 9*f*.

Figure 10A:
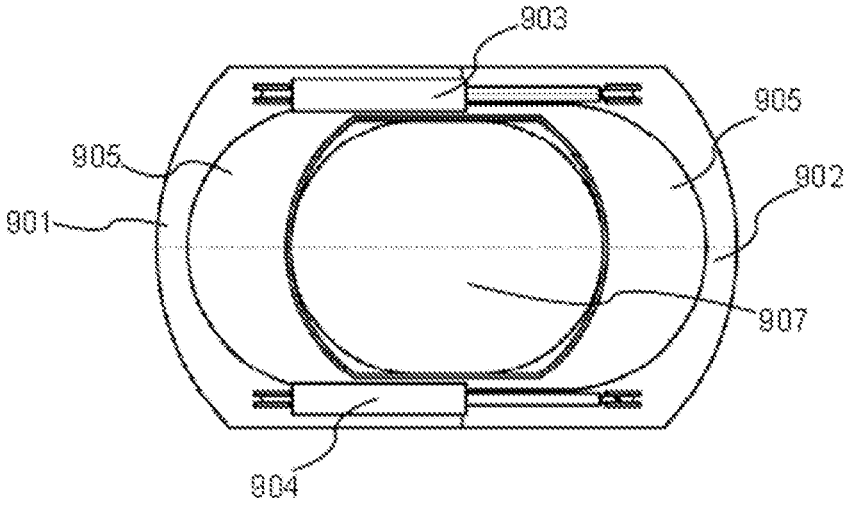
FIGS. 10*a* and 10*b* show a top view of two adjusting parts of an adjusting apparatus according to a preferable embodiment of the invention in different positions.
Figure 10B:
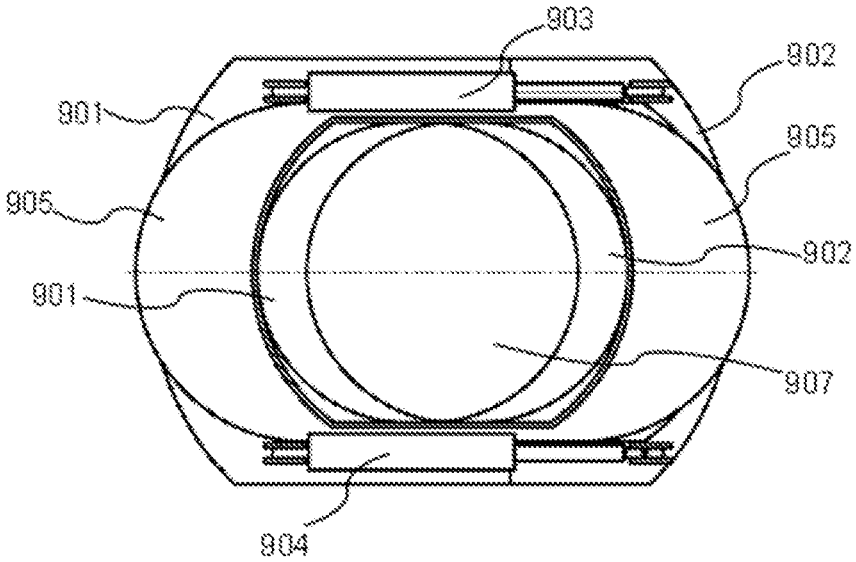

FIGS. 10*a* and 10*b* show a top view of two adjusting parts of an adjusting apparatus according to a preferable embodiment of the invention in different positions. In FIGS. 10*a* and 10*b*, same referral numbers are used of like parts as in FIGS. 9*a* to 9*f*. In FIGS. 10*a* and 10*b*, the actuators (adjusting cylinders 903 and 904) controlling the size of the flow opening 907 are arranged between two adjusting parts (adjusting plates 901 and 902). First ends of the adjusting cylinders 903 and 904 are in the first adjusting plate 901 and second ends in the second adjusting plate 902 of the opposite side.

Also such embodiments are implementable in the adjusting apparatuses of FIGS. 9*a* to 9*f* and 10*a* to 10*b* that the actuator (adjusting cylinder) may be two-ended and fixed in the centre to the body of the adjusting apparatus. Alternatively the adjusting apparatus may have two actuators per side, and one end of the actuator is fixed to the body and the second end is moving the adjusting part.

Figure 11A:
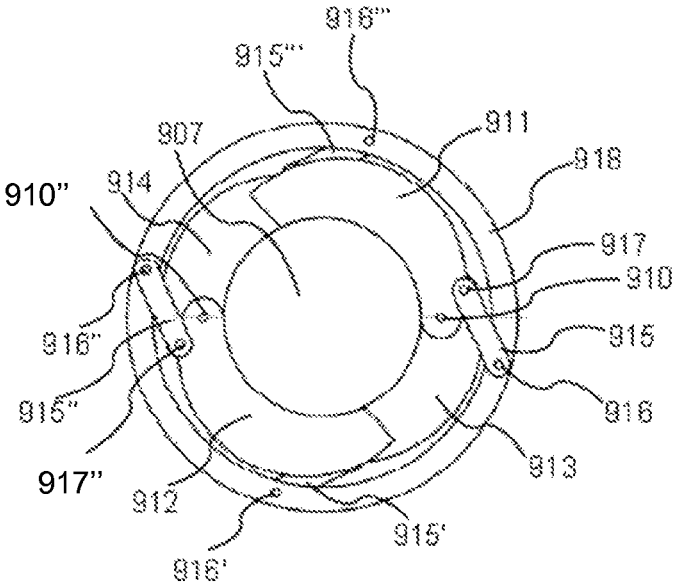
FIGS. 11*a*, 11*b* and 11*c* show a top view of four adjusting parts of an adjusting apparatus according to a preferable embodiment of the invention in different positions.
Figure 11B:
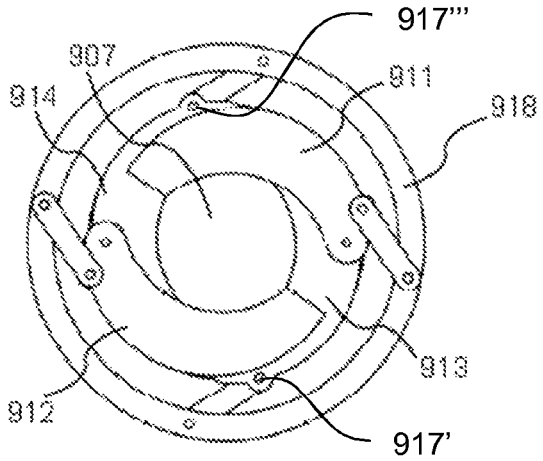
Figure 11C:
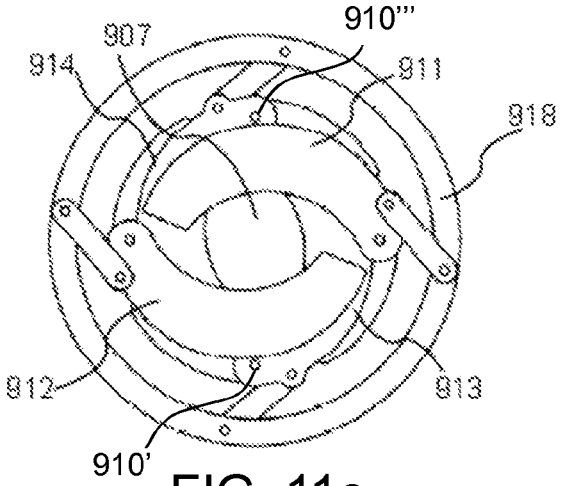

FIGS. 11*a*, 11*b* and 11*c* show a top view of four adjusting parts of an adjusting apparatus according to a preferable embodiment of the invention in different positions. The adjusting apparatus shown in FIGS. 11*a*, 11*b* and 11*c* has a familiar function principle with the adjusting apparatus 10 shown in FIGS. 3 to 6. The adjusting apparatus comprises an adjusting ring 918 and by rotating said adjusting ring counterclockwise the adjusting parts 911 to 914 are moving such that the flow opening 907 is decreasing. The flow opening 907 is increasing when the adjusting ring 918 is rotated clockwise.

The adjusting parts 911 to 914 are arranged to move by rotating relative to first pins 910, 910', 910", 910'''. The first pins are acting as rotating axes of the adjusting parts. The first pins are additionally connected to the adjusting ring 918 via intermediate rods 915, 915', 915", 915". First ends of the intermediate rods are pivoted via second pins 916, 916', 916", 916''' to the adjusting ring 918 and second ends of the intermediate rods are pivoted via third pins 917, 917', 917", 917''' to the adjusting parts.

The adjusting ring 918 can be moved for example by a gear transmission such that an outer side of the adjusting ring is machined in form of a gear. Alternatively the adjusting ring may be stationary in the body or part of the body, and the intermediate rods may be for example hydraulic cylinders.

In FIGS. 11*a* to 11*c*, the adjusting parts 911 to 914 are acting as adjusting parts which are movable during crushing for adjusting the flow area A of the material which is to be crushed and is flowing through the feed opening 121 to the crushing chamber 122.

In a preferable operating method of the crusher the setting of the crusher 120, the surface height of the material to be crushed and the size of the feed opening 121 of the crushing chamber 122 can be adjusted. By the adjusting a better end result may be achieved in which the capacity of the crusher is utilized as effectively as possible and the amount of the objected end product is maximized.

Figure 12:
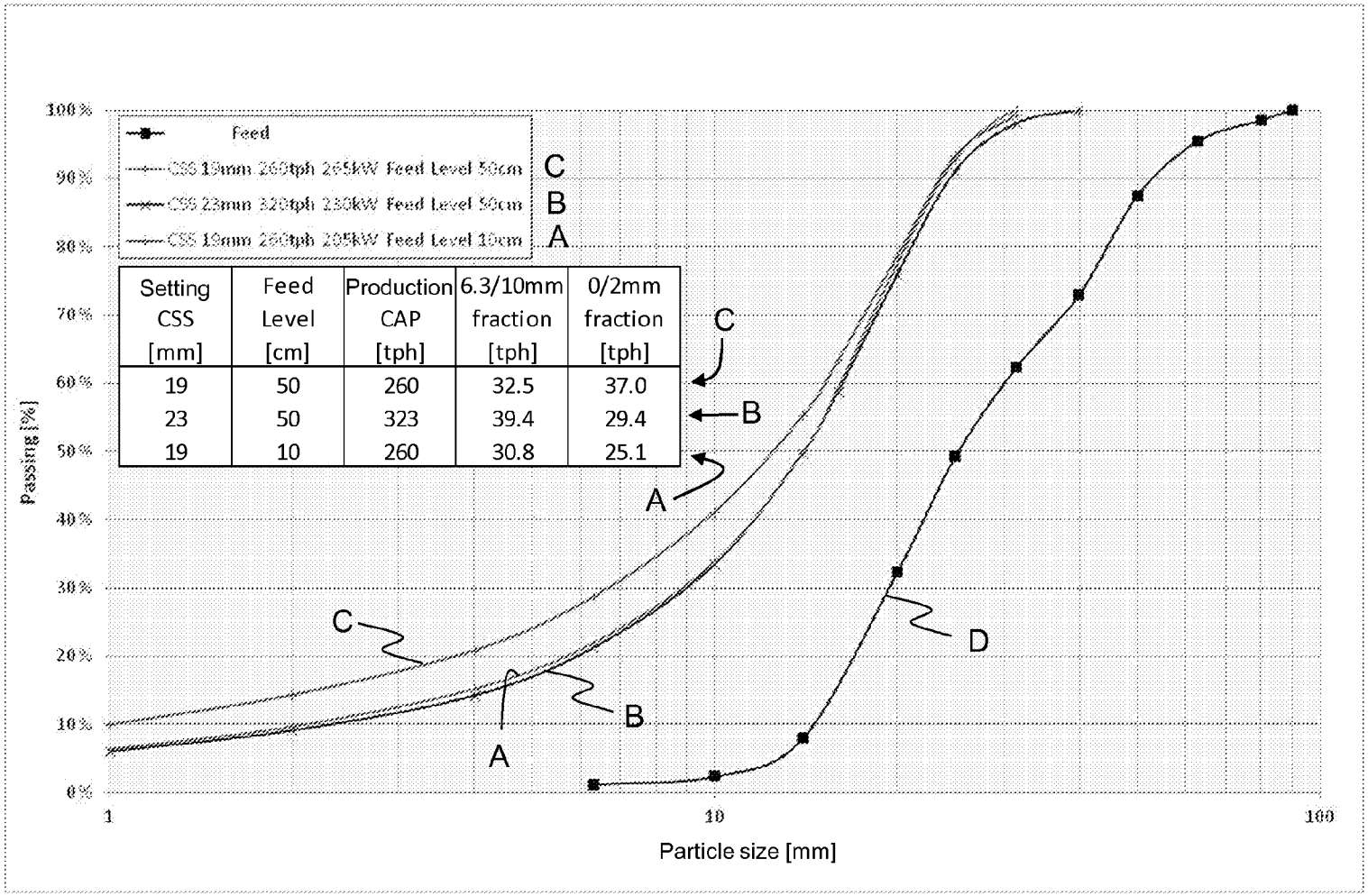
FIG. 12 shows schematically the impact of setting and surface height of the crusher on the product distribution of the crusher.

FIG. 12 shows an example of the impact of the setting CSS and surface height of the material to be crushed on the product distribution. According to FIG. 12, when there is arranged a low surface height of about 10 cm in the feed hopper 150 of the crusher and setting 19 mm, approximately the same product distribution is gained as with a higher surface height of about 50 cm and with a 4 mm larger setting. It can be found in the example that the surface height has a substantial effect on the end product, particularly on the amount and distribution of the end product.

Figure 14A:
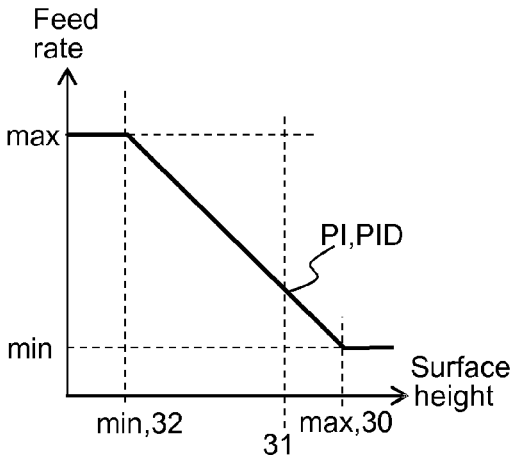
FIGS. 14*a* and 14*b* show examples of methods for adjusting a crusher.

According to a preferable embodiment of the invention there is provided a first adjusting manner in which there is sought a suitable size of the adjusting opening. After that the distribution of the end product is aimed to make constant by adjusting the feed rate (effect on the surface height) and/or the setting of the crusher. FIG. 14*a* is associated with the adjusting of the feed rate and FIG. 14*a* is associated with the adjusting of the setting. The right form of the product distribution to be made constant is case specific for example according to the example of FIG. 7. Particle size is shown on the horizontal axis and passing of the particles is shown on the vertical axis. Curve D shows the grain size of the input.

According to an example the crusher is operated with the first adjusting manner in which it is targeted to minimize the production of the fraction 0-2 mm and maximize the production of the fraction 6.3-10 mm. The target can be achieved with the following combinations of adjusting parameters: surface height 10 cm-setting 19 mm (curve A) wherein is generated a lowest amount 25.1 t/h of the minimum fraction; and surface height 50 cm-setting 23 mm (curve B) wherein is generated an amount 29.4 t/h of the minimum fraction. With the combination surface height 50 cm-setting 19 mm (curve C) too much of the fraction 0-2 mm would be generated (37.0 t/h). According to the curve B a larger production amount 323 t/h of the targeted maximum fraction 6.3-10 mm is gained than with curve A (260 t/h). When taken into account that by adjusting the crusher the amount of the maximum fraction, which can be sold with good margins, can be maximized, so it is advantageous that the power of the crusher can be optimized on a perfect level, preferably 230 kW in the production according to the curve B (curve A 205 kW; curve B 265 kW). By increasing the setting of the crusher (from setting 19 to setting 23) the product distribution is not changed substantially but the output of the crusher with regard to the desired fraction 6.3-10 mm is increased when the capacity of the crusher was utilized effectively.

According to a preferable embodiment of the invention there is provided a second adjusting manner in which the surface height, the setting and additionally the feed opening is adjusted, and further the end product is aimed to be made constant. With these adjustments it is also possible to optimize a specific end product.

By right selection of the size of the feed opening an overload can be limited and overload situations can be controlled.

Figure 13:
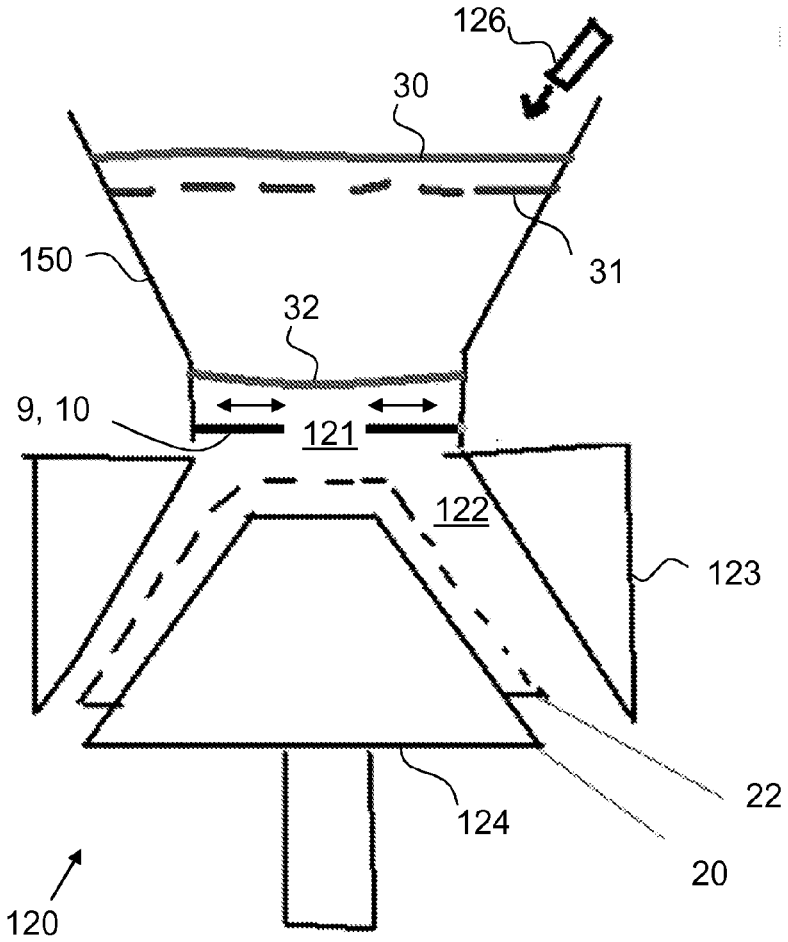
FIG. 13 shows a crusher.

FIG. 13 shows a crusher 120 above which is arranged a feed hopper 150. The material is flowing to the crushing chamber 122 of the crusher through an adjustable 9 (adjusting apparatus 10) feed opening 121. The crushing chamber 122 is located between a stationary outer wear part 123 and a rotatable inner wear part 124. The setting of the crusher is adjusted by moving the inner wear part vertically relative to the outer wear part. The surface height of the material in the feed hopper is measured for example by a surface sensor 126.

In a first phase of an example the setting 20 of the upper surface of the crusher 120 is sought by holding the surface of the material to be crushed in the feed hopper 150 (or in a silo above the crusher) at an upper limit 130. In FIG. 13 the location of the inner crusher blade 124 is shown by a continuous line 20 in the setting corresponding to the upper limit 30 of the material.

In a second phase the size of the feed opening 121 is adjusted in a such start position that a high surface height 30 of the material in the feed hopper and the setting producing a desired product distribution do not cause any overload situation. In other words, the size of the feed opening is adjusted so that the maximum power of the crusher is nearby reached when the crushing capacity is highest.

In a third phase the surface height of the material in the feed hopper is lowered in a lower position 32 and it is measured how much the setting shall be decreased in order to hold the product distribution desired. In FIG. 13 the location of the inner crusher blade 124 is shown by a dashed line 22 in the setting corresponding to the lower limit 32 of the material.

The setting 20 of the maximum surface height 30 and the setting 22 of the minimum surface height 32 are selected to parameters of the setting adjustment window of the crusher load state.

In a fourth phase a such state is sought for the crusher in a controlled manner that an overload situation in connection with the start, a so called start peak, is not caused when there is crushed with a certain setting. In the fourth phase the setting is adjusted to a desired position (to a position which is corresponding to a desired product distribution). The feed opening 121 is adjusted to a minimum when the crusher is in idle state in order that the load peak in the next feeding start would be as low as possible and the feed opening is increased in a controlled manner.

In a fifth phase maximum surface height 30-*x* cm is selected the target surface 31 of the feeding adjustment.

In a crushing phase the crusher power is limited quickly, for example in an overload situation, by adjusting the feed opening 121. Exceeding of the maximum power limit, in which situation the rotation of the crusher is slowing down or the setting of the crusher should be increased in order to get out of an overload situation, is avoided sufficient early by adjusting the feed opening 121. Operating the crusher with a limited rotation speed or the opening of the setting would cause limited use of the crushing capacity and would depress making use of the whole capacity of the crusher.

When the surface height is increasing in the feed hopper or the silo, the pressure in the crushing chamber is increasing, the material is getting denser in the crushing chamber under the pressure, and finally it may happen that the power of the crusher does not suffice and there is generated an overload situation. In the traditional adjusting manner the feeding of the material to be crushed to the feed hopper or silo is decreased when the surface height in the feed hopper or silo is increased. Decreasing the feeding is causing however with a delay to the overload situation.

In a sixth phase the particle size distribution is adjusted: material is fed to the h 150 or silo until the upper limit 30 (maximum surface height) of the material is reached. After that the feed opening 121 in a manner being near the maximum power of the crusher. The particle size is held independently from the surface height of the material in the feed hopper 150 or silo. Then by a certain first setting can be operated with the maximum surface height and by a certain second setting can be operated with the minimum surface height, and between the maximum and minimum surface heights there can be operated in a region between the first and second settings, for example according to the example of FIG. 14*b*.

Figure 14B:
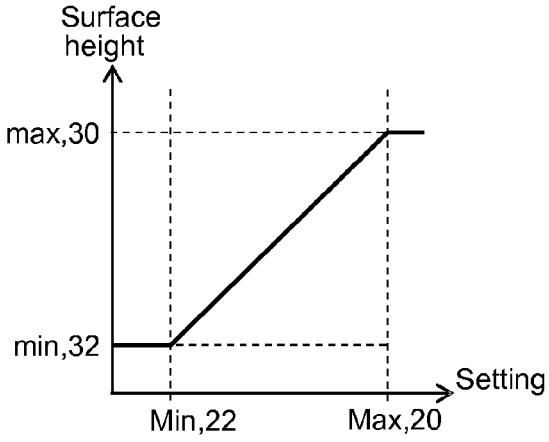

FIGS. 14*a* and 14*b* show examples of an adjusting method of a crusher.

In the diagram of FIG. 14*a*, there is presented on the vertical axis the feed rate (to the feed hopper or the silo) of the material to be crushed and on the horizontal axis the surface height (in the feed hopper or the silo) of the material. Preferably the min-position of the surface height is the lower limit 32 of the material and the max-position of the surface height is the upper limit 30 of the material in FIG. 13. The target height of the surface is denoted 31. In the target position there is preferably implemented a PI-control or a PID-control according to which the more there is deviated from the target the quicker the feed rate is adjusted.

In the diagram of FIG. 14*b*, there is presented on the vertical axis the surface height (in the feed hopper or the silo) of the material to be crushed and on the horizontal axis the setting of the crusher. Preferably the Min-position of the setting is the setting 22 at the lower limit 32 of the material and the Max-position of the setting is the setting 20 at the upper limit 30 of the material in FIG. 13.

When the determinations of the start phase of the method are made, the crusher can be operated with full capacity without taking care of the surface height as an absolute value.

It is preferable to make the determinations for avoiding the start peak (the above described fourth phase) before adjustments which are relating to the actual crushing event. The setting corresponding to the maximum surface height can be determined in connection with the adjusting of the feed opening 121 and the determination of the maximum power intake (maximum capacity of the crusher) during crushing, after which is determined the setting corresponding to the lowest surface height in order to get the same desired distribution. When the surface height is lowered, the setting is increased in order to get the same end product as with the higher surface height. When the setting is adjusted the crushing can be continued such that the surface height does not affect the distribution of the end product. A target in the crushing is to maintain the surface height near the maximum surface height in order to protect the crusher from overriding the maximum power and at the same time however to crush with the highest possible power.

According to a preferable embodiment of the invention there is implemented a method for avoiding the start peak of the crusher 120, in connection of which crusher there is arranged an adjusting apparatus 10 which comprises one or more movable adjusting parts 5, 6, 7, 8; 901, 902; 911, 912, 913, 914 in connection with the feed opening 121 of the crushing chamber 122 of the crusher. The method comprises measuring a change of surface height 32-30 of the material to be crushed and setting the unitary flow opening A comprised by the movable adjusting parts of the adjusting apparatus 10 in a minimum size, if the power of the crusher, the pressure in the crushing chamber or the surface height of the material to be crushed reaches a predetermined limit such as the power, the pressure or the surface height in an idle situation of the crusher. Further the setting of the crusher may be decreased towards a minimum value. The setting and the size of the flow opening may be increased as a response to the change of the surface height.

In connection with the start or when the crushing chamber gets empty during crushing, the setting can be decreased in addition to the adjusting of the flow opening in order to avoid access of oversized crushed material to the end product or a following crushing phase. The setting can be decreased by adjusting the volume flow and at the same time stay under predetermined power and/or pressure limits.

According to a preferable embodiment of the invention there is implemented a method for adjusting a pressing crusher 120 or a crushing plant 100 suitable for mineral material crushing, which crusher or crushing plant comprises a crushing chamber 122 and a feed opening 121 of the crushing chamber, and measuring means for measuring production amounts of at least two different fractions from the crushed material, and an adjusting apparatus 10, one or more adjusting parts 5, 6, 7, 8; 901, 902; 911, 912, 913, 914 comprised by which adjusting apparatus are arranged in connection with the feed opening 121, the method comprising adjusting a location of a unitary flow opening A formed by the movable adjusting parts of the adjusting apparatus and/or the size of the flow opening A in relation to the feed opening 121 as a response to a change of the production amount of the fraction. The location of the flow opening of the adjusting apparatus may be adjusted in vertical and/or horizontal direction. Further a flow area A of material which is to be crushed and is flowing through the feed opening to the crushing chamber can be adjusted during crushing by moving the adjusting parts such that the flow area is decreased when the crushing power and/or the crushing pressure and/or the surface height measured by the measuring means is increasing and the flow area is increased when the crushing power and/or the crushing pressure and/or the surface height measured by the measuring means is decreasing.

The measuring means for measuring the production amounts of the two or more different fractions can be implemented for example by measuring the mass or volume flow of each fraction which is conveyed on an output conveyor by suitable sensors and measuring methods, speed of a conveyor belt, pressure of a hydraulic motor, power of an electric motor and by comparing corresponding values with each other.

According to a preferable embodiment of the invention there is implemented a method for limiting power intake and/or crushing pressure of a crusher in connection with crushing, which crusher comprises a feed hopper 150 above the crushing chamber 122, and the method comprising forming by one or more movable adjusting parts 5, 6, 7, 8; 901, 902; 911, 912, 913, 914 comprised by an adjusting apparatus 10 a unitary flow opening A in connection with a feed opening 121 of the crushing chamber and adjusting the size of the flow opening such that a surface height of the material to be crushed in the feed hopper does not cause overriding of a predetermined power or pressure limit during crushing. The adjusted size of the flow opening can be used as the maximum size of the flow opening in this crushing situation.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of the principles of the invention, and not in limitation thereof. Hence, the scope of the invention is only restricted by the appended patent claims.

The invention claimed is:

1. A pressing mineral material crusher comprising:

a crushing chamber;

a feed opening of the crushing chamber;

a measuring means for measuring at least one of crushing power used, a crushing pressure and a surface height of mineral material in the crushing chamber; and an adjusting apparatus including a body and a plurality of adjusting parts each bearing-mounted at their first ends to the body by rotating axes, each of the plurality of adjusting parts including a second end rotatable about the rotating axes, wherein curved front edges of the adjusting parts combine to form a single unitary flow opening having a flow area which is adjustable by moving the plurality of adjusting parts, and wherein the plurality of adjusting parts are arranged such that the curved front edges form a perimeter around the flow area of the flow opening, and the flow area is adjustable by moving the plurality of adjusting parts, and the plurality of adjusting parts are configured to move such that the flow area is decreasing when at least one of the crushing power, the crushing pressure and the surface height measured by the measuring means is increasing and the flow area is increasing when at least one of the crushing power, the crushing pressure and the surface height measured by the measuring means is decreasing.

2. The crusher of claim 1, wherein the crusher further comprises a crusher drive and an adjusting system with a feedback, which adjusting system comprises a power measuring means of the crusher drive and/or a pressure measuring means of the crushing event and moving means of the adjusting parts for adjusting the adjusting parts based on the power measuring and/or the pressure measuring.

3. The crusher of claim 1, wherein the crusher is a gyratory or a cone crusher.

4. The crusher of claim 1, wherein the crusher comprises a stationary wear part and a movable wear part, the distance between the stationary wear part and the movable wear part being changing during crushing.

5. A crushing plant comprising:

a pressing mineral material crusher comprising a crushing chamber, a feed opening of the crushing chamber, and a measuring means for measuring at least one of crushing power used, a crushing pressure and a surface height of mineral material in the crushing chamber, wherein the crusher comprises an adjusting apparatus comprising a body and a plurality of adjusting parts each bearing-mounted at their first ends to the body by rotating axes and second ends of the plurality of adjusting parts are rotatable around the rotating axes, wherein curved front edges of the adjusting parts form a single unitary flow opening having a flow area which is adjustable by moving the plurality of adjusting parts, and wherein the plurality of adjusting parts are arranged such that the curved front edges form a perimeter around the flow area of the flow opening, and the flow area is adjustable by moving the plurality of adjusting parts, and the plurality of adjusting parts are configured to move such that the flow area is decreasing when at least one of the crushing power, the crushing pressure and the surface height measured by the measuring means is increasing and the flow area is increasing when at least one of the crushing power, the crushing pressure and the surface height measured by the measuring means is decreasing.

6. An adjusting apparatus positioned above a feed opening for a crushing chamber of a mineral crusher, the adjusting apparatus comprising:

a body; and a plurality of adjusting parts each having a first end, a second end and a curved front edge extending from the first end to the second end, wherein each first end is bearing-mounted to the body about a vertical rotating axis and each second end is rotatable around the vertical rotating axis of the adjusting part, wherein the plurality of adjusting parts are mounted to the body such that the curved front edges combine to define a perimeter of a single unitary flow opening having a flow area, each of the plurality of adjusting parts being rotatable about the vertical rotating axes to selectively modify the flow area.

7. The adjusting apparatus of claim 6 wherein the body includes a bottom part and an upper part fixed together, wherein the plurality of adjusting parts are supported between the bottom part and the upper part in vertical direction.

8. The adjusting apparatus of claim 6, wherein the plurality of adjusting parts are configured to be moved such that the plurality of adjusting parts are moved towards the flow opening for decreasing the flow area of the flow opening, and the plurality of adjusting parts are moved away from the flow opening for increasing the flow area of the flow opening.

9. The adjusting apparatus of claim 6, wherein the plurality of adjusting parts are locatable before the feed opening in flow direction of the material to be crushed.

10. The adjusting apparatus of claim 6, wherein the second ends of the plurality of adjusting parts are rotatable around the rotating axes and the rotating axes are vertical.

11. The adjusting apparatus of claim 6, wherein the body comprises a bottom part and an upper part fixed together and the plurality of adjusting parts are supported between the bottom part and the upper part in vertical direction.

12. The adjusting apparatus of claim 6, wherein the plurality of adjusting parts are arranged in two layers.

13. The adjusting apparatus of claim 6, wherein the body and the plurality of adjusting parts are plate structures.

* * * * *